US008011210B2

(12) United States Patent
Heubner et al.

(10) Patent No.: US 8,011,210 B2
(45) Date of Patent: Sep. 6, 2011

(54) WASHING DRUM FOR A LAUNDRY TREATING MACHINE

(75) Inventors: Axel Heubner, Berlin (DE); Alfred Nitsche, Berlin (DE); Wilfried Wildung, Berlin (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 499 days.

(21) Appl. No.: 11/920,890

(22) PCT Filed: Feb. 22, 2006

(86) PCT No.: PCT/EP2006/060180

§ 371 (c)(1),
(2), (4) Date: Feb. 25, 2009

(87) PCT Pub. No.: WO2006/122839

PCT Pub. Date: Nov. 23, 2006

(65) Prior Publication Data

US 2009/0183531 A1 Jul. 23, 2009

(30) Foreign Application Priority Data

May 20, 2005 (DE) ..... 10 2005 023 444

(51) Int. Cl.
*D06F 37/06* (2006.01)

(52) U.S. Cl. ..... 68/3 R; 68/232; 29/896.6

(58) Field of Classification Search ..... 68/3 R, 68/142, 232, 242; 29/896.6
See application file for complete search history.

(56) References Cited

U.S. PATENT DOCUMENTS

| | | | | | |
|---|---|---|---|---|---|
| 1,355,918 | A | * | 10/1920 | Schroeder | 220/309.2 |
| 1,524,123 | A | * | 1/1925 | Fisher | 68/142 |
| 1,728,667 | A | * | 9/1929 | Curtis | 68/142 |
| 1,951,470 | A | * | 3/1934 | Cole | 29/506 |
| 1,968,679 | A | * | 7/1934 | Gerlach | 68/142 |
| 2,198,873 | A | | 4/1940 | Hinsdale | |
| 4,298,061 | A | * | 11/1981 | Hoeffken | 165/170 |
| 4,628,617 | A | * | 12/1986 | St. Louis | 34/108 |
| 5,746,070 | A | * | 5/1998 | Bailey et al. | 68/24 |
| 2002/0020203 | A1 | | 2/2002 | Rolf | |

(Continued)

FOREIGN PATENT DOCUMENTS

| | | |
|---|---|---|
| DE | 1 099 946 | 2/1961 |

(Continued)

OTHER PUBLICATIONS

International Search Report PCT/EP2006/060180.

*Primary Examiner* — Frankie Stinson
(74) *Attorney, Agent, or Firm* — James E. Howard; Andre Pallapies

(57) ABSTRACT

The invention relates to washing drum shell formed by a final sheet metal strip which is coiled in the form of a cylinder and whose ends are welded to one another. The longitudinal sides thereof are connected to a bottom disk by a high-flange joint provided with transversal embossments. The high flange joint is sufficiently stable even when the carriers of the washing drum are drawn into the shell. The drawn-in carriers are connected by at least one fold to openings shaped in at least one bottom disk and the transversal embossments of the high flange joint are shaped in an area which is arranged directly near a connection between the drawn-in carriers and the bottom disk.

16 Claims, 4 Drawing Sheets

U.S. PATENT DOCUMENTS

2005/0132556 A1* 6/2005 Bobed ..... 29/505

FOREIGN PATENT DOCUMENTS

Figure 1:
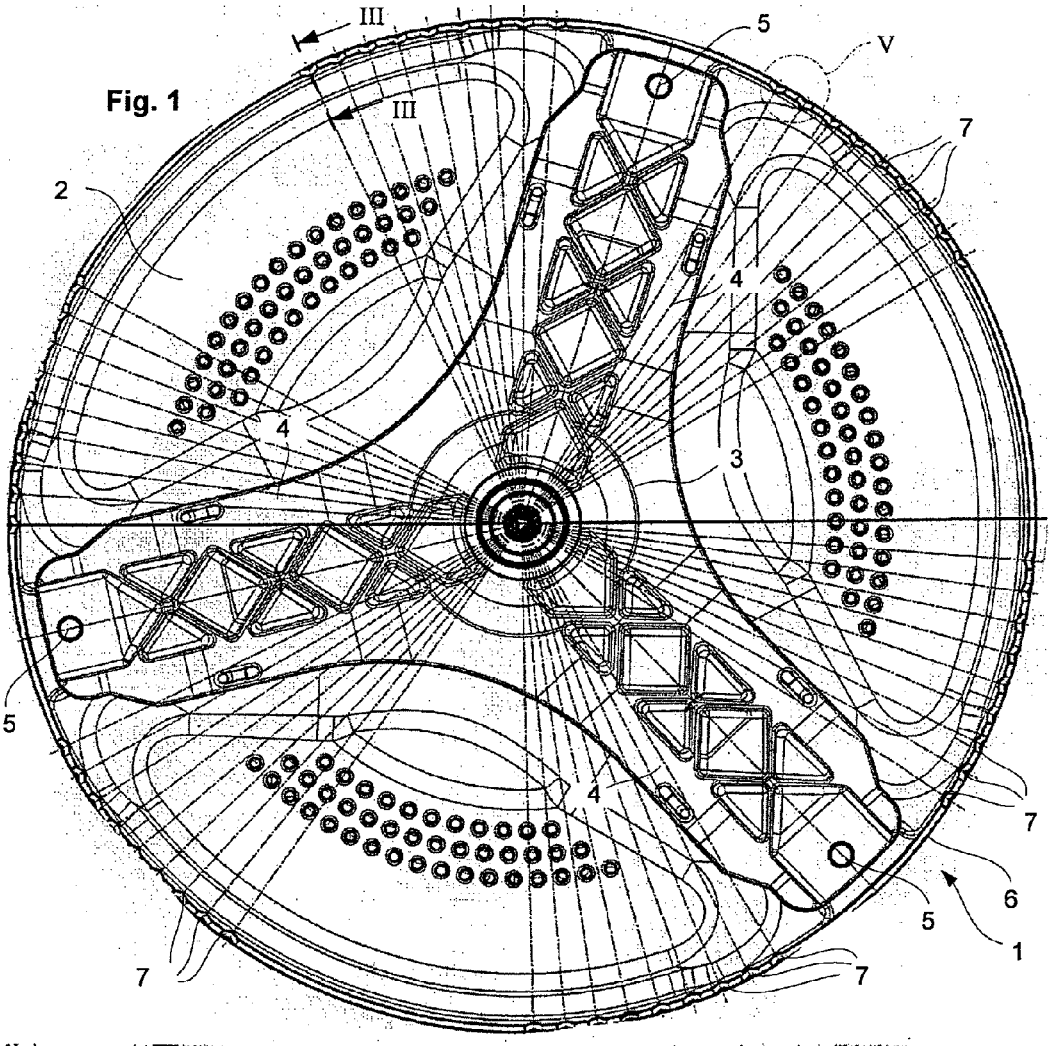

| | | | |
|---|---|---|---|
| DE | 30 41 506 | * | 6/1982 |
| DE | 92 02 791 U | | 10/1992 |
| DE | 198 21 366 | | 8/1999 |
| DE | 100 06 975 | | 8/2001 |
| EP | 0 318 109 | | 5/1989 |
| EP | 0 395 859 | | 11/1990 |
| EP | 0 810 315 | | 12/1997 |
| EP | 1 505 188 | | 2/2005 |
| GB | 1 360 545 | | 7/1974 |
| GB | 2 096 649 | * | 10/1982 |
| JP | 10-080595 | * | 3/1998 |
| JP | 11-147147 | * | 6/1999 |

* cited by examiner

WASHING DRUM FOR A LAUNDRY TREATING MACHINE

The invention relates to a laundry drum for a laundry-treating machine having a shell formed from a finite sheet-metal strip that is bent into a cylindrical shell and whose end sides are joined in a welded seam and whose long sides are joined to the periphery of the bottom disk and of the front bottom disk by means of an edge-formed seam provided with transversal embossments. The invention relates further to a tool and a method for working an aforementioned laundry drum.

Drums of the kind cited in the introduction have already been embodied where the embossments on the circumference of the edge-formed seam are arranged evenly disposed to make the edge-formed seam more resistant to opening. The known edge-formed seam can perform said function satisfactorily. It is, however, to be noted that said manner of strengthening edge-formed seam has no effect on the stability of the connection of carriers drawn in as a single piece from the drum shell and joined to the bottom disk and front bottom disk of the laundry drum.

The object of the invention is therefore to undertake measures on a laundry drum described in the introduction to the effect that, when carriers drawn in as a single piece from the metal shell sheet are provided, the edge-formed seam will also be made sufficiently stable so that the metal shell sheet will not become detached from the connection to the bottom disk when the laundry drum is spinning at higher speeds.

Said object is achieved according to the invention by means of a laundry drum in the case of which carriers drawn according to the exemplary embodiments described herein inwardly in from the sheet-metal strip are joined by means of a fold to incisions or openings provided in at least one of the bottom disks and through applying the embossments on the edge-formed seam in the area immediately next to where the carriers are joined to the bottom disks. The shell's sheet-metal strip—also called a metal shell sheet—will owing to good form closure and frictional engagement between the metal shell sheet and respective bottom disk consequently be joined to the respective bottom disk so securely in the circumferential and radial direction that this strength will also impact on the stability of the carrier, which when subjected to higher spin speeds will consequently be rendered less susceptible to deforming owing to the tractive shell forces occurring around the circumference of the laundry drum, meaning along the metal shell sheet, because of the high centrifugal forces during spinning.

What has proved especially advantageous is a development of the invention in which at least seven though preferably nine embossments are provided in serried succession along the edge-formed seam in each case in front of and after the join to the carrier. Because there are weaknesses in, on the one hand, the bottom disk and, on the other, the metal shell sheet (owing to the drawn-in carrier) specifically where the carriers are joined to the bottom disks, stabilizing of the edge-formed seam by means of embossments specifically in the immediate vicinity of the connection points is especially advantageous. Said embossments can have an identical mutual centerline spacing.

What has proved especially suitable is to dimension the embossments such that their serried succession is determined substantially by a mutual centerline spacing of the embossments at least approximately double the width of one embossment. Said close emplacement of the embossment in the edge-formed seam will obviously have such a stabilizing effect that no other stabilizing measures will be needed up to spin speeds of 1,400 rev/min when such a laundry drum is used.

As the forces are determined largely by angular momenta introduced into the laundry drum via its bearing bracket directly where the carriers are joined to the rear bottom disk, the highest density of embossments is advantageous in that vicinity and is achieved principally by lengthening the centerline spacing with increasing distance of the embossment from where the carrier is joined to the bottom disk.

Stabilizing can be best optimized when, according to the exemplary embodiments described herein, the first embossments situated in front of and after where the carrier is joined to the bottom disk follow on directly from the draw-in for the carrier.

A centerline spacing in the range between 13 and 22 mm between the embossments on in each case one side of the carrier has proved to offer dimensioning that accords well with all requirements relating to strength and ease of manufacture. It will further be advantageous for the deepest edge of the embossments to be a straight line sloping down from the drum shell to the bottom disk relative to the shell line. A further vector of the force-resisting counterforces will be introduced thereby so that none of the intertwined sheet-metal edges will, despite the elasticity of the edge-formed seam, be able to work free from the join.

The slope of the deepest edge of the embossments advantageously has an angle of at least approximately 15°. When sheet metal having an approximately 0.6-mm gauge is used, what will then ensue as the depth of the deepest edge, compared with the highest elevation of the outer edge of the embossments, is at least approximately 0.5 mm on the end facing the drum shell and at least approximately 3 mm on the end facing away therefrom. What is therein advantageous is that the relatively large embossment depth will not cause any visible deformations in the metal shell sheet or in the sheet metal of the bottom disk or, as the case may be, front bottom disk.

A laundry drum conforming to the invention can best be produced in a tool if the pre-shaped laundry drum is placed for working on a table and dies that can be moved substantially radially toward the edge-formed seam for providing embossments therein are arranged on the side of the laundry drum that is being worked.

The dies are best arranged in groups in which the middle die or dies or a notional bisecting line between two dies is/are oriented on the center of the assigned bottom disk. A plurality of dies can then be economically controlled jointly. The slight departure of the striking direction from the radial direction will therein be acceptable.

From the economic viewpoint, further rationalizing is even possible though providing on the periphery of the laundry drum just one die station in which the dies are arranged in groups and that is oriented toward that area of the edge-formed seam that is situated in each case next to where a drawn-in carrier is joined.

Then if the table is linked to a turning device which, after a die strike, moves the laundry drum to another position in which a further die strike is to be made at the same die station, then despite a turning drive necessary for the table it will be possible to save substantial costs on the tool through having just one group of dies along with their drive.

For insuring precise embossments and only slight deformation of the adjacent areas, it would be advantageous for, according to the exemplary embodiments described herein, a bottom die for applying against the edge-formed seam to be provided in the tool opposite the die station.

For an inventive method for working a pre-shaped laundry drum having an edge-formed seam according to one of the exemplary embodiments described herein, the laundry drum is advantageously placed in a tool in such a way that the edge-formed seam's area requiring to be worked is positioned in front of a die station, that the embossments are made through in each case a single, externally applied strike onto the edge-formed seam using a die, and that after each die strike the laundry drum is further turned through a specific angle such that the embossments in the edge-formed seam in the area immediately next to where the carriers are joined to the bottom disks will be applied a pre-calculated distance apart. A tool according to one of the exemplary embodiments described herein is advantageously used for the inventive method for working a laundry drum according to one of the exemplary embodiments described herein.

Figure 2:
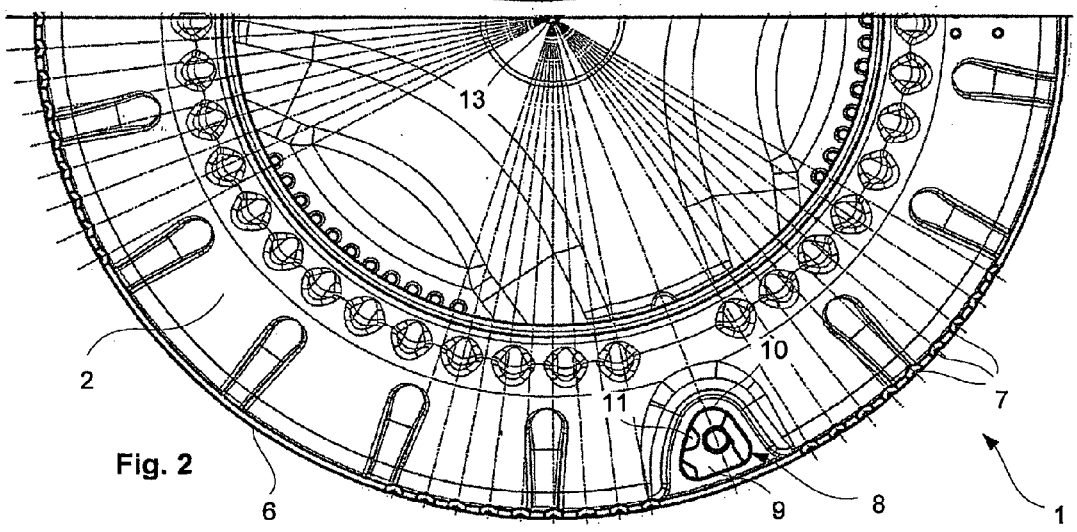
Figure 3:
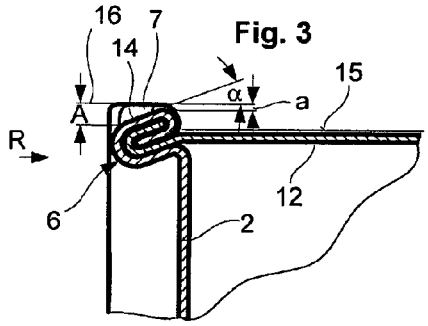
Figure 4:
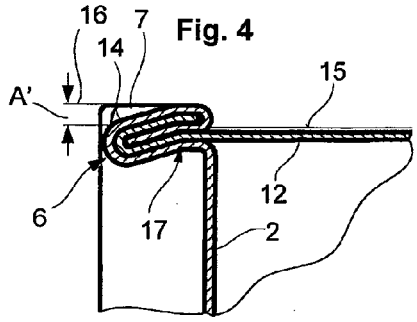
Figure 6:
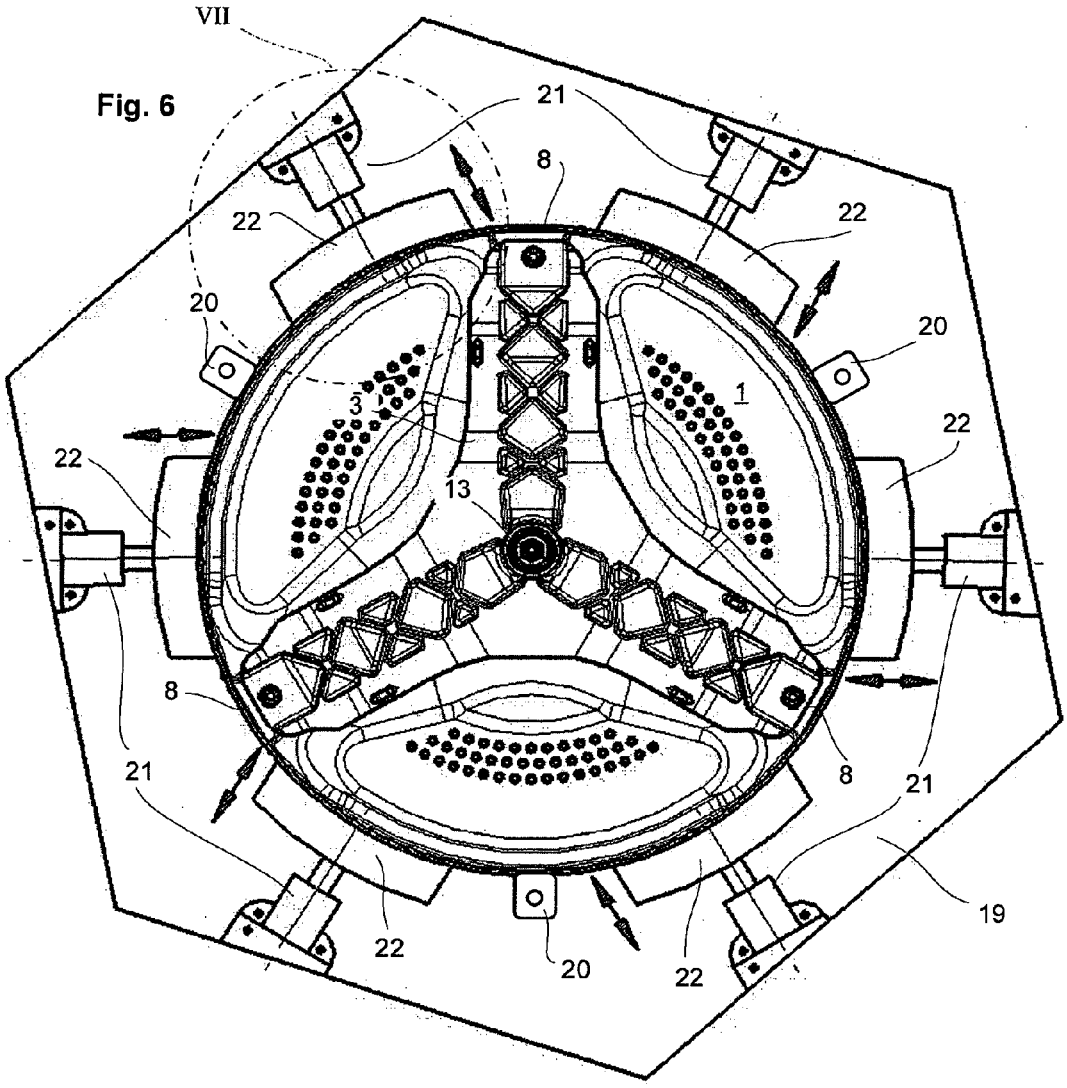
Figure 5:
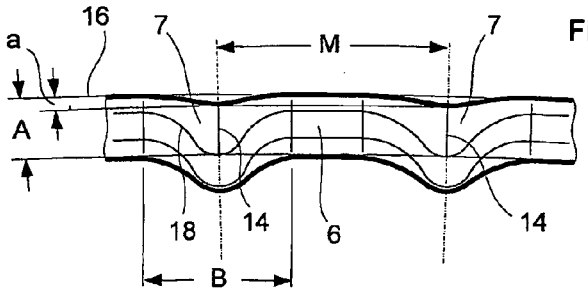
Figure 7:
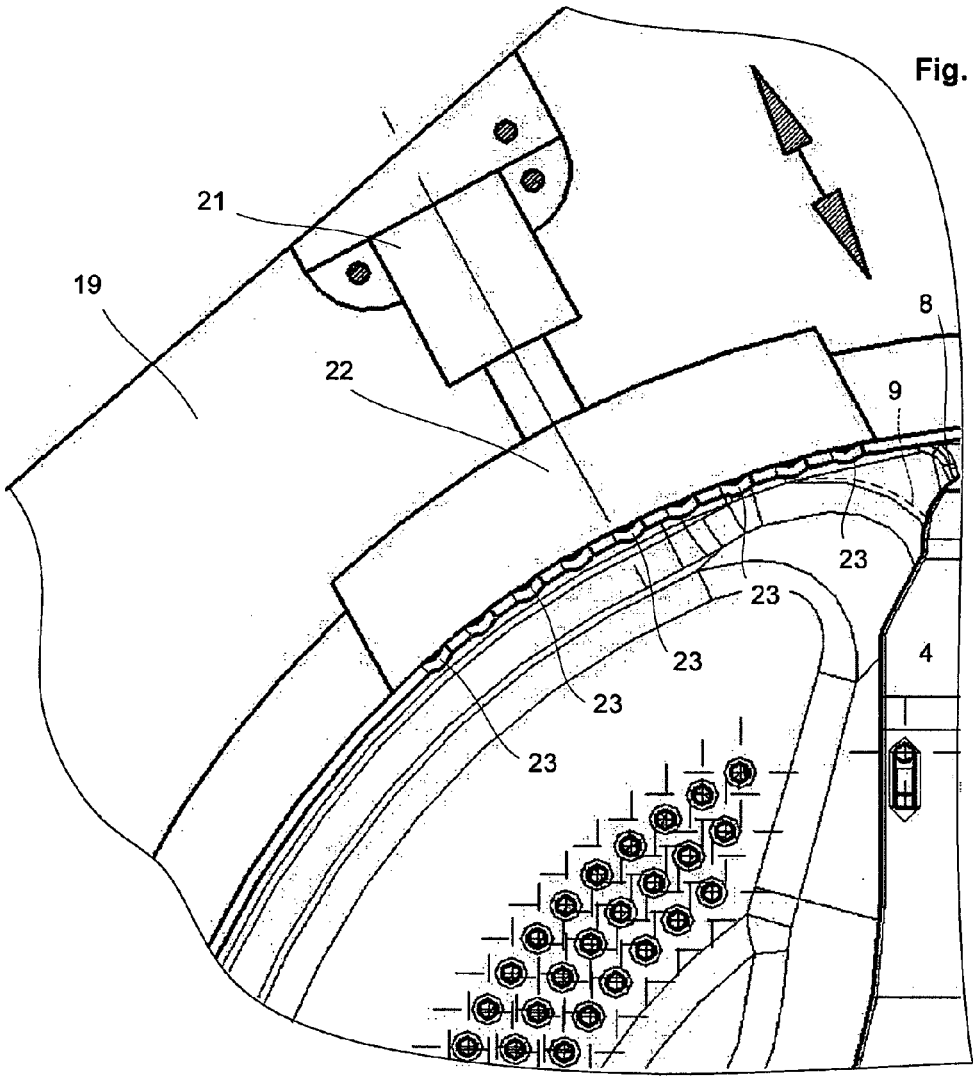
Figure 8:
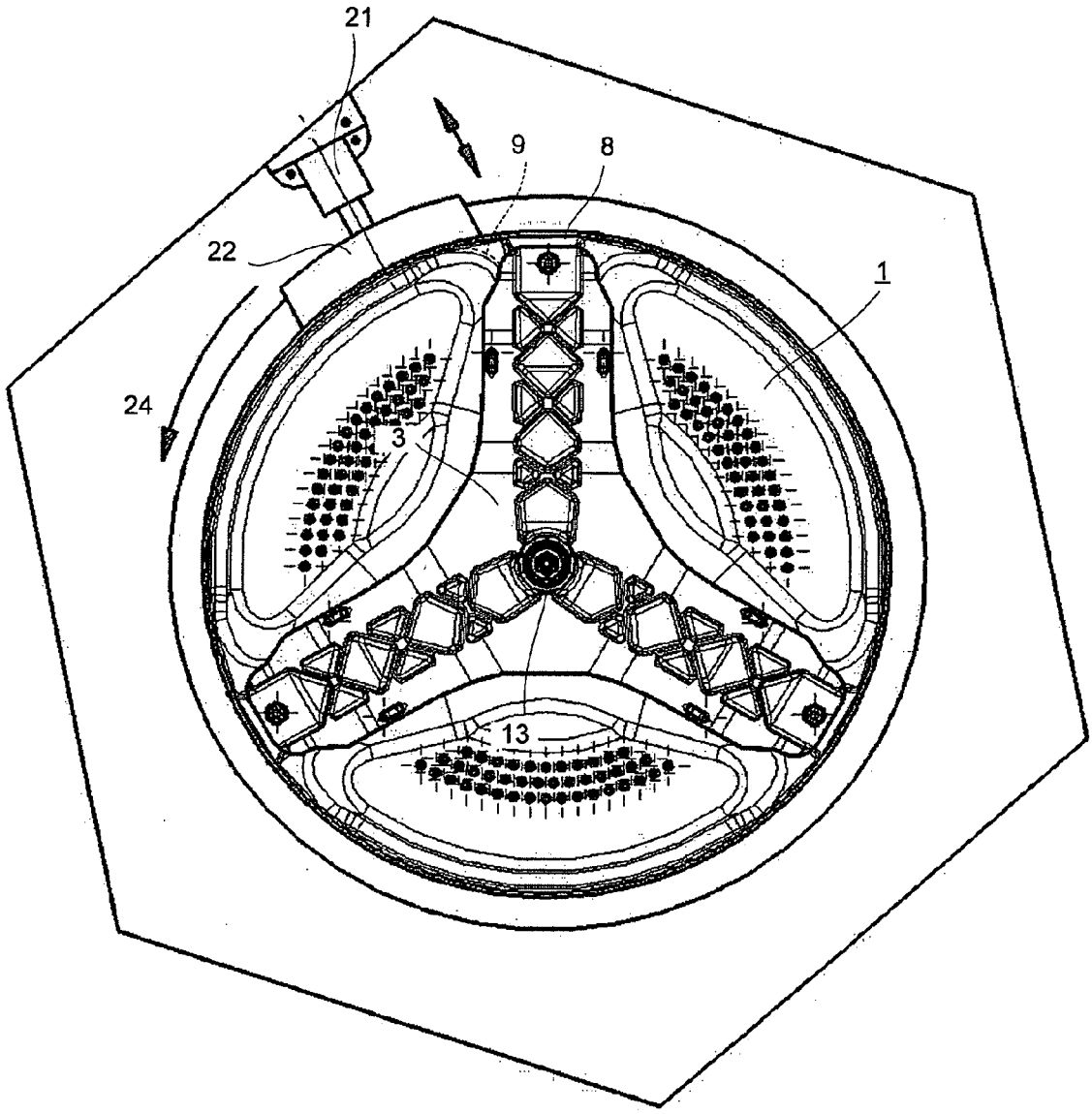

The invention is explained in more detail below with reference to exemplary embodiments shown in the drawing, in which:

FIG. 1 is the view onto the bearing bracket and rear bottom disk of a laundry drum according to the invention, FIG. 2 is the same view onto a half of the bottom disk with the bearing bracket removed, FIG. 3 shows an enlarged cross-section of a section through the edge-formed seam at the height of an embossment along the line of intersection III-III shown in FIG. 1, FIG. 4 shows a cross-section according to FIG. 3 for an alternatively shaped edge-formed seam, FIG. 5 shows the enlarged view onto the edge of the edge-formed seam at the height of two embossments according to detail V shown in FIG. 1, FIG. 6 shows a view onto a tool according to the invention having a laundry drum positioned on the work table, FIG. 7 shows an enlarged view onto a die head for embossing the edge-formed seam according to detail VII shown in FIG. 6, and FIG. 8 shows a variant embodiment of a tool according to the invention as shown in FIG. 6, but having just one die station and a rotary table for the laundry drum.

The view shown in FIG. 1 onto the rear bottom disk 2 of a laundry drum 1 conceals its shell (12 in FIGS. 3 and 4) and the congruent front bottom disk, which in a front-loading washing machine is furnished with a circular coaxial opening for loading laundry. A bearing bracket 3 is mounted on the bottom disk 2 in such a way that the ends of its arms 4 are secured to the bottom disk 2 at the height of the carriers via holes 5 and screws (not shown).

FIG. 1 also shows an edge-formed seam 6 that encloses the edge of the bottom disk 2, is oriented parallel to the shell line 15 (FIG. 3), and by means of which the bottom disk 2 is joined in a manner explained further below to the metal shell sheet 12 of the laundry drum 1. Said edge-formed seam 6 is provided in each case immediately in front of and after the join to the carrier 9 (and to the end of the bearing-bracket arm) with embossments 7, in each case nine in number spaced equidistantly.

With the bearing bracket 3 removed in FIG. 2, detaching of the arms 4 affords a view onto the join 8 of the carriers 9, which join is made to the bottom disk 2 at an opening 10, matched in the shape of a profile of the carriers 9, by means of one or more folds 11. With the bearing bracket 3 mounted, said join is additionally secured by means of a cup nut inserted behind the fold 11 and by means of the screw traversing the hole 5 in the arm 4 of the bearing bracket 3 (nut and screw not shown). Other types of join such as, for instance, riveted joints, can of course also be selected instead of screw joints.

The embossments 7 are illustrated in the cross-sectional view shown in FIG. 3. It can be seen therefrom that the edges of the bottom disk 2 and of the metal shell sheet 12 have been bent round to form an edge-formed seam 6 which at the site of the embossment 7 has been deep drawn-in section-by-section toward the center point 13 of the bottom disk 2. With the shell line 15, the deepest line 14 therein forms an angle $\alpha$ of approximately 15°, as a result of which, relative to the outer circumferential line 16 of the edge-formed seam 6, the deepest line 14 is lowered by only a minimum depth $a \approx 0.5$ mm on the shell side of the embossment 7 and by a maximum depth $A \approx 3$ mm on the bottom-disk side.

In an alternative shape shown in FIG. 4, the edge-formed seam 6 within the embossment 7 is shaped downward around a fold line 17 away from the orientation parallel to the shell line 15 so that the deepest line 14 at the height of the fold line 17 ends at the same height as the outer circumferential line 16 of the edge-formed seam 6. The deepest line 14 will consequently on the bottom-disk side attain only a maximum depth $A' \approx 2.5$ mm at the same angle $\alpha \approx 15°$. A further vector of the force-resisting counterforces will thereby be introduced into the embossment 7 compared with the embossment shown in FIG. 3 because a further securing component will have been worked into the edge-formed seam 6 within the intertwined sheet-metal edges by the fold line 17.

What can be seen in FIG. 5 from the viewing direction R indicated in FIG. 3 is the view onto the edge-formed seam 6 at the height of two embossments 7 according to detail V shown in FIG. 1. Proceeding from the outer circumferential line 16 of the edge-formed seam 6, the embossments 7 are lowered to their deepest lines 14. They therein attain a minimum depth $a \approx 0.5$ mm in the top area, near the circumferential line 16, and in the bottom area, far from the circumferential line 16 and at the deepest point on the contour edge 18, a maximum depth $A \approx 3$ mm. The mutual centerline spacing M of the two embossments 7 is here shown as being somewhat less than twice the width B of an embossment 7, and can be between around 13 and around 22 mm. It can, though, also be equal to the width B or exceed it. However, an excessively large centerline spacing M will impact negatively on the strength of the edge-formed seam and on the magnitude of the forces transferable from the bearing bracket to the drum.

A laundry drum 1 according to the exemplary embodiments described in FIGS. 1 to 5 can be produced through working in a tool according to FIG. 6. Said type of laundry drum will actually already have been finished before being placed into the tool shown in FIG. 6 and be suitable for use in washing machines designed for maximum spin speeds of around 1,000 rev/min. The described edge-formed seam 6 will require no embossments for that. Only laundry drums 1 intended for washing machines designed for faster rotational speeds should be reinforced at least in the area of the join 8 of the carriers 9 to the bottom disks 2 by the inventive arrangement of the embossments 7. A tool of the kind shown in FIG. 6 serves to do that.

Attached to the table 19 of the tool is a multi-part work-holding fixture 20 for positioning and securing the laundry drum 1. The laundry drum has three carriers 9 and, corresponding thereto, a three-armed bearing bracket 3. Assigned to each carrier 9 is a die station 21 whose dies 22 are attached in such a way that they can move toward the center 13 of the bottom disk 2 or, as the case may be, of the coaxial center line of the laundry drum 1. In this exemplary tool embodiment, two dies 22 are in each die station 21 set up for each side of the edge-formed seam circumferentially in front of and after the join 8 to the carriers 9 and each die 22 according to FIG. 7 is set up with nine embossing profiles 23, each of which is provided for producing an embossment 7. Eight embossments 7 can thus be produced simultaneously on both sides in front of and after the join 8 by means of a single strike of all dies 22 in the direction of the double arrow.

It is, though, possible with each die also to strike, for example, only four embossments 7 whose mutual spacing on each side of the edge-formed seam is sufficiently large for in each case one further embossment to fit between them. The laundry drum 1 is after one die strike in the direction of the double arrow then turned on the table 19 to an extent that four further embossments 7 are made on each side precisely between the pairs of embossments 7. Eight embossments 7 will thus have been provided on each side of the joins 8 by means of two strikes.

Just one die station 21—possibly representative of in each case one die station for each carrier join 8—is shown on the tool table 19 in the example shown in FIG. 8 of a tool whose basic structure greatly resembles that shown in FIG. 6. After each die strike the laundry drum 1 must then be turned on the table 19, or with a part thereof, through an angle in the direction of arrow 24 such that the respectively other area next to the carrier join 8 will be positioned in the die station 21. So when there is just one die station 21 on the table 19 the laundry drum 1 will have to maintain six turning positions until all embossing groups have been struck. Only two turning positions will have to be maintained in the case of the arrangement having one die station for each join 8.

Instead of the paired or grouped arrangement of embossing profiles 23, with which arrangement the strikes of the dies 22 are, in a manner that is acceptable, executed not precisely in the radial direction, each die can also be equipped with just one embossing profile 23. It will then be possible to execute each die strike precisely in the radial direction, albeit the number of dies will then, due to the confined space on the tool table 19, have to be limited such that, for providing all embossments 7, the laundry drum 1 will be further turned more than once per group of embossments 7 and that a plurality of strikes will have to be performed in the direction of the double arrow for each group of embossments around the carrier.

The described working of the laundry drum 1 can with a tool of said type be carried out at each bottom disk 2 individually or at the front bottom disk and rear bottom disk simultaneously. Appropriate die arrangements must, of course, in the latter case be provided in two stages of the same tool.

REFERENCE CHARACTERS

α Angle of deepest line
a Minimum depth of embossment
A Maximum depth of embossment
1 Laundry drum
2 Bottom disk
3 Bearing bracket
4 Arm
5 Holes
6 Edge-formed seam
7 Embossments
8 Join
9 Carrier
10 Opening
11 Fold
12 Metal shell sheet
13 Center of bottom disk
14 Deepest line
15 Shell line
16 Outer line of edge-formed seam
17 Fold line
18 Contour edge
19 Table
20 Work-holding fixture
21 Die station
22 Die
23 Embossing profile

The invention claimed is:

1. A laundry drum for a laundry appliance, the laundry drum comprising:

a.) a cylindrical shell having an axial end portion and being formed from a finite sheet-metal strip that is bent into the cylindrical shell and whose end sides are joined in a welded seam;

b.) an end cap, the end cap having an overall cylindrical periphery of a diameter corresponding to the diameter of the cylindrical shell;

c.) an edge-formed seam element interconnecting the axial end portion of the cylindrical shell and the cylindrical periphery of the end cap, the edge-formed seam including transversal embossments;

d.) a plurality of carriers, each carrier being integrally formed with the cylindrical shell and extending radially inwardly from the cylindrical shell at the axial end portion thereof and the carriers being distributed at discrete angular locations around the cylindrical shell, the end cap having a plurality of end cap opening edges each forming an end cap opening, the number of end cap openings corresponding in number to the plurality of carriers, the radially innermost portion of each carrier being received in a respective one of the end cap openings and being interconnected with the respective end cap opening edge via a folding together of an edge of the carrier and the respective end cap opening edge; and e.) a plurality of embossments formed on the edge-formed seam at at least one area adjacent to each interconnection of a respective carrier and a respective end cap opening edge.

2. The laundry drum as claimed in claim 1, wherein at least four and preferably nine embossments are provided in serried succession along the edge-formed seam in each case in front of and after each interconnection of a respective carrier and a respective end cap opening edge.

3. The laundry drum as claimed in claim 2, wherein the embossments have identical mutual centerline spacing.

4. The laundry drum as claimed in claim 3, wherein the serried succession is determined substantially by a mutual centerline spacing of the embossments at least approximately double the width of one embossment.

5. The laundry drum as claimed in claim 4, wherein the centerline spacing between the embossments on in each case one side of each carrier is in the range between 13 and 22 mm.

6. The laundry drum as claimed in claim 5, wherein the slope of the deepest edge of the embossments has an angle of at least approximately 15°.

7. The laundry drum as claimed in claim 5, wherein the depth of the deepest edge, compared with the highest elevation of the outer edge of the embossments, is at least approximately 0.5 mm on the end facing the drum shell and at least approximately 3 mm on the end facing away from the drum shell.

8. The laundry drum as claimed in claim 2, wherein the centerline spacing is lengthened with increasing distance of the embossment from each interconnection of a respective carrier and a respective end cap opening edge.

9. The laundry drum as claimed in claim 2, wherein the first embossments are situated in front of and after each interconnection of a respective carrier and a respective end cap opening edge follow on directly from the draw-in for the carrier.

10. The laundry drum as claimed in claim 1, wherein the deepest edge of the embossments is a straight line sloping down from the drum shell to the end cap relative to the shell line.

11. A device for manufacturing a laundry drum for a laundry-treating machine, the device comprising:

a.) a table on which the pre-shaped laundry drum is intended to be placed, the laundry drum having a shell formed from a finite sheet-metal strip that is bent into a cylindrical shell and whose end sides are joined in a welded seam and whose long sides are joined to the periphery of a bottom disk and/or of a front bottom disk by means of an edge-formed seam provided with transversal embossments, wherein carriers drawn inwardly in from the sheet-metal strip are joined by means of a fold to incisions or openings provided in at least one of the bottom disks and in that the embossments on the edge-formed seam are applied in the area immediately next to the join of the carriers to at least one of the bottom disks; and b.) dies that can be moved substantially radially toward the edge-formed seam for providing embossments in the edge-formed seam, the dies being arranged on the side being worked of the laundry drum.

12. The device as claimed in claim 11, wherein the dies are arranged in groups in which at least one of the middle dies or a notional bisecting line between two dies is oriented on the center of the assigned bottom disk.

13. The device as claimed in claim 11, wherein on the periphery of the laundry drum just one die station is provided in which the dies are arranged in groups and that is oriented toward the area of the edge-formed seam, which area is situated in each case next to the join of a drawn-in carrier.

14. The device as claimed in claim 13, wherein the table is linked to a turning device which, after a die strike, moves the laundry drum to another position in which a further die strike is to be made at the same die station.

15. The device as claimed in claim 13, wherein one of the dies is a bottom die for applying against the edge-formed seam and is provided opposite the die station.

16. A laundry drum made by a process comprising:

a.) placing a pre-shaped laundry drum for a laundry-treating machine in a tool, the laundry drum having a shell formed from a finite sheet-metal strip that is bent into a cylindrical shell and whose end sides are joined in a welded seam and whose long sides are joined to the periphery of a bottom disk and/or of a front bottom disk by means of an edge-formed seam provided with transversal embossments, wherein carriers drawn inwardly in from the sheet-metal strip are joined by means of a fold to incisions or openings provided in at least one of the bottom disks and the embossments on the edge-formed seam are applied in the area immediately next to the join of the carriers to at least one of the bottom disks, and the laundry drum being placed in a tool in such a way that the area to be worked of the edge-formed seam is positioned in front of a die station;

b.) making the embossments via, in each case, a single, externally applied strike onto the edge-formed seam using a die, and c.) after each die strike, further turning the laundry drum through a specific angle such that the embossments in the edge-formed seam in the area immediately next to the join of the carriers to at least one of the bottom disks will be applied a pre-calculated distance apart.

* * * * *